US009801444B2

(12) United States Patent
Watson

(10) Patent No.: US 9,801,444 B2
(45) Date of Patent: Oct. 31, 2017

(54) STORAGE SYSTEM AND CASE

(71) Applicant: Christopher M. Watson, Washington, PA (US)

(72) Inventor: Christopher M. Watson, Washington, PA (US)

(73) Assignee: C. H. J. Watson Inc., Washington, PA (US)

( * ) Notice: Subject to any disclaimer, the term of this patent is extended or adjusted under 35 U.S.C. 154(b) by 467 days.

(21) Appl. No.: 14/182,636

(22) Filed: Feb. 18, 2014

(65) Prior Publication Data

US 2014/0231286 A1 Aug. 21, 2014

Related U.S. Application Data

(63) Continuation of application No. 13/006,409, filed on Jan. 13, 2011, now abandoned.

(60) Provisional application No. 61/336,003, filed on Jan. 13, 2010.

(51) Int. Cl.
*A45C 11/00* (2006.01)
*F41B 5/14* (2006.01)

(52) U.S. Cl.
CPC ..... *A45C 11/00* (2013.01); *F41B 5/14* (2013.01)

(58) Field of Classification Search
CPC ..... A45C 11/00; F41B 5/14
See application file for complete search history.

(56) References Cited

U.S. PATENT DOCUMENTS

| | | | | |
|---|---|---|---|---|
| 1,982,845 | A * | 12/1934 | Wagman | A45C 3/06 383/33 |
| 2,423,889 | A | 7/1947 | Hurt | |
| 2,540,165 | A * | 2/1951 | Fiel | A45C 3/10 190/111 |
| 2,837,132 | A | 6/1958 | Daust | |
| 3,403,716 | A | 10/1968 | Irwin | |
| D248,794 | S | 8/1978 | Cooper | |
| 4,153,146 | A | 5/1979 | Patton et al. | |
| 4,515,300 | A | 5/1985 | Cohen | |
| 4,756,394 | A | 7/1988 | Cohen | |
| 5,005,679 | A | 4/1991 | Hjelle | |
| 5,209,279 | A | 5/1993 | Wilson | |
| 5,307,908 | A | 5/1994 | Shyr et al. | |
| 5,649,658 | A * | 7/1997 | Hoffman | A45F 3/04 190/2 |
| 5,704,529 | A | 1/1998 | Santoro et al. | |
| 5,873,504 | A | 2/1999 | Farmer | |
| 6,015,072 | A | 1/2000 | Young | |
| 6,899,460 | B2 * | 5/2005 | Turvey | B65D 33/007 383/33 |
| D543,021 | S | 5/2007 | Lee et al. | |
| D572,471 | S | 7/2008 | Saconay-Duhart | |
| 7,900,757 | B2 | 3/2011 | Sisitsky | |
| 2002/0074199 | A1 | 6/2002 | Albritton | |
| 2004/0238303 | A1 | 12/2004 | Hafif | |

(Continued)

*Primary Examiner* — Tri Mai
(74) *Attorney, Agent, or Firm* — Barclay Damon, LLP

(57) ABSTRACT

A case for equipment includes, in an embodiment, at least: (a) one storage compartment having an extendable bag; and (b) a mat compartment configured to hold an extendable mat. A portion of the storage compartment is configured to be rolled-up. The case also has a zipper track and a stiffener. During roll-up, the stiffener is folded over the zipper track at least once for a more tight sealing of the zipper track.

22 Claims, 20 Drawing Sheets

(56) References Cited

U.S. PATENT DOCUMENTS

| | | | |
|---|---|---|---|
| 2006/0027475 | A1 | 2/2006 | Gleason et al. |
| 2006/0283907 | A1 | 12/2006 | Green et al. |
| 2009/0250362 | A1 | 10/2009 | Melmon et al. |

* cited by examiner

STORAGE SYSTEM AND CASE

CROSS-REFERENCE TO RELATED APPLICATIONS

This application is a continuation of U.S. patent application Ser. No. 13/006,409 (filed Jan. 13, 2011) which claims the benefit of U.S. Provisional Patent Application Ser. No. 61/336,003 (filed Jan. 13, 2010). These applications are hereby incorporated by reference into this specification.

BACKGROUND OF THE INVENTION

The subject matter disclosed in this specification relates to storage systems and more particularly, to storage systems for archery equipment and accessories.

Storage systems, and particularly those configured to store archery equipment, do not have the ability to store, conveniently and in an organized fashion, equipment, clothing, gear, and related accessories in a rugged, easily maneuverable storage device. Moreover, archery equipment and gear tends to adsorb undesirable odors when exposed to human environments. Accordingly, there is a need for a rugged archery equipment storage system capable of storing arrows, camo, boots, hats, gloves, calls, releases, scents, lures, treestand equipment and tackle, for example, capable of including a changing mat, and configured to include one or more compartments to lock out odors and keep clothing scent-free.

The discussion above is merely provided for general background information and is not intended to be used as an aid in determining the scope of the claimed subject matter.

BRIEF DESCRIPTION OF THE INVENTION

Disclosed in this specification is a carrying case for scent-free storage of archery equipment including at least a first compartment suited for clothing and a second compartment configured to store a changing mat. An advantage that may be realized in the practice of some disclosed embodiments of the storage system is the ability to maintain hunting equipment in a scent-free environment. The hunting equipment does not adsorb human scents and these scents are therefore are not subsequently detected by game.

In one embodiment, a carrying case for the scent-free storage of hunting gear is provided. The carrying case comprises a first compartment with an internal extendable bag may be extended out of the first compartment. The extendable bag comprises a zipper with two pulls and a fabric sealed on at least one side with a waterproofing coating. The extendable bag is permanently joined to the first compartment only around a periphery of the zipper. Clips are provided, one set adjacent each end portion of the zipper and another set on opposite sides of the carrying case. A rigid strip is disposed proximate the zipper such that the zipper is inset from the opening of the extendable bag by the rigid strip. The carrying case is configured to secure the first compartment and its contents in a rolled up condition to provide a scent-free environment by pulling at least one of the pulls to seal the zipper at a non-terminal position of the zipper, folding the rigid strip over the zipper at least once, and securing the two sets of first clips to the two sets of second clips. A second compartment is disposed on an external surface of the carrying case and houses an extendable changing mat irremovably secured to a portion of the second compartment. The second compartment comprising a flap with one edge of the flap permanently attached to the carrying case.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which:

The present invention is disclosed with reference to the accompanying drawings, wherein:

FIG. 13A is a perspective view of a detachable field storage system while

FIG. 15 is a perspective view of the second embodiment showing the placement of the detachable field bag while

DETAILED DESCRIPTION OF THE INVENTION

Figure 1:
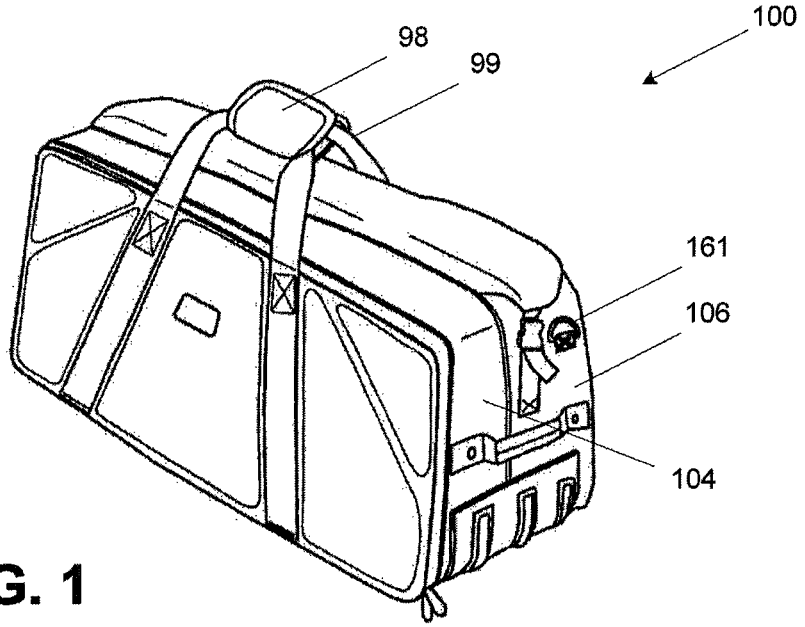
FIG. 1 is a perspective front view of a first embodiment of a storage system.
Figure 2:
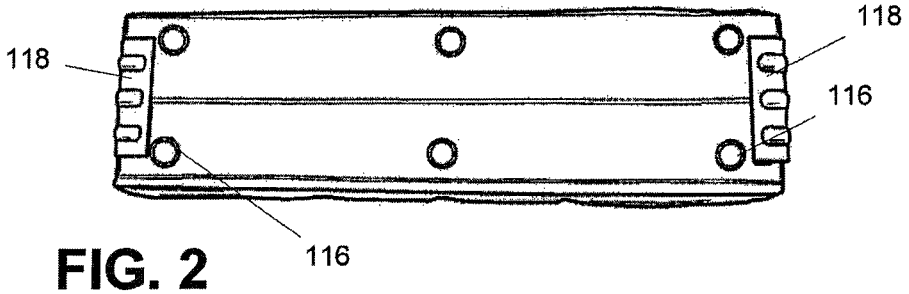
FIG. 2 is a bottom view of the first embodiment.
Figure 3:
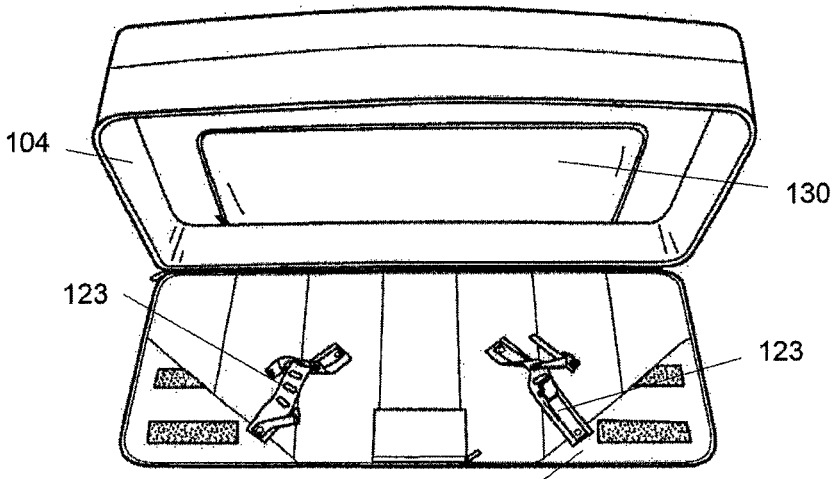
FIG. 3 is a perspective front view of the first embodiment with the storage compartment open.
Figure 4:
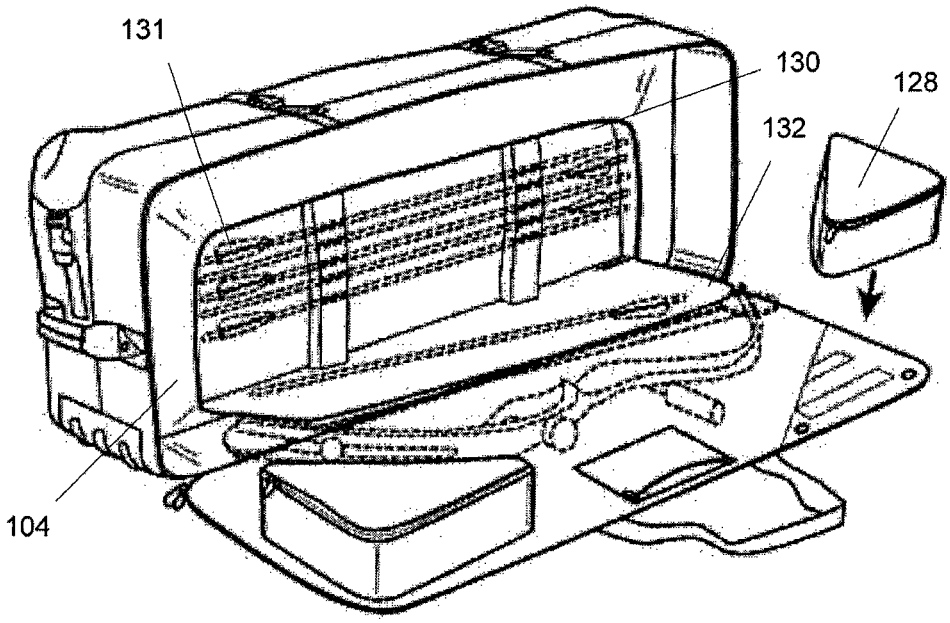
FIG. 4 is a view similar to FIG. 3 with a bow shown in phantom.
Figure 5:
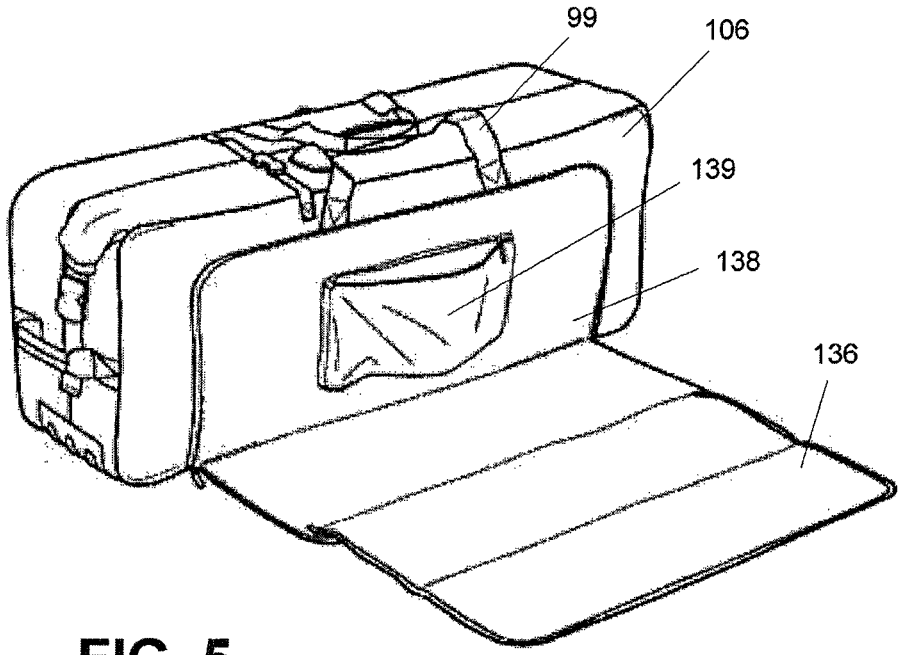
FIG. 5 is a rear perspective view of the first embodiment with a changing mat extended.
Figure 6:
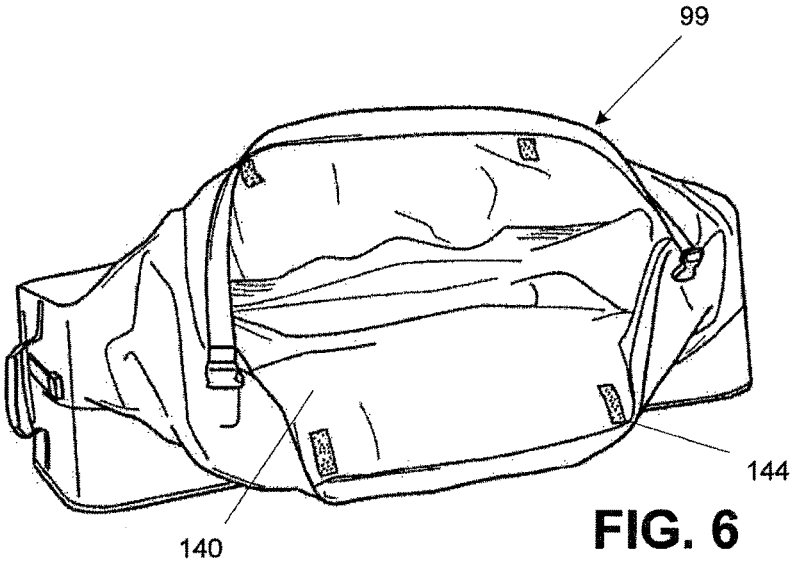
FIG. 6 is a rear view of the first embodiment with the clothing compartment open.
Figure 7:
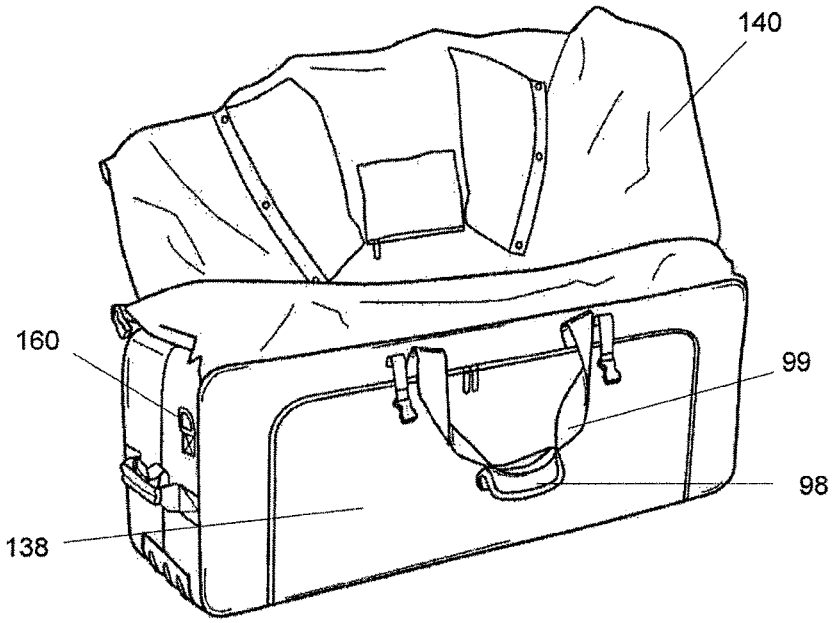
FIG. 7 is a rear view of the first embodiment with the clothing compartment lining extended.
Figure 8A:
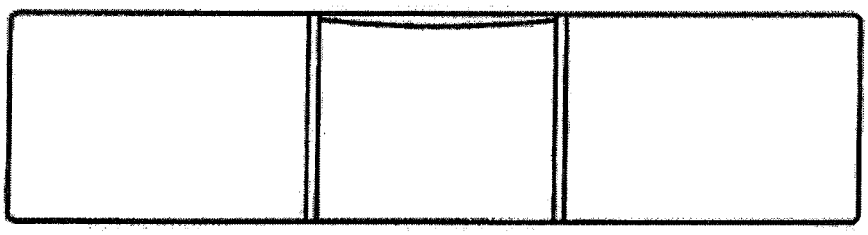
FIG. 8A-8D are schematic depictions of dividers utilized in the clothing compartment of the first embodiment.
Figure 8B:
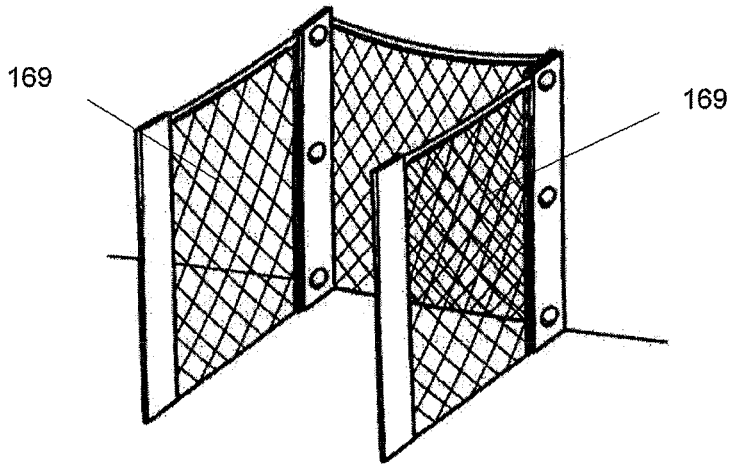
Figure 8C:
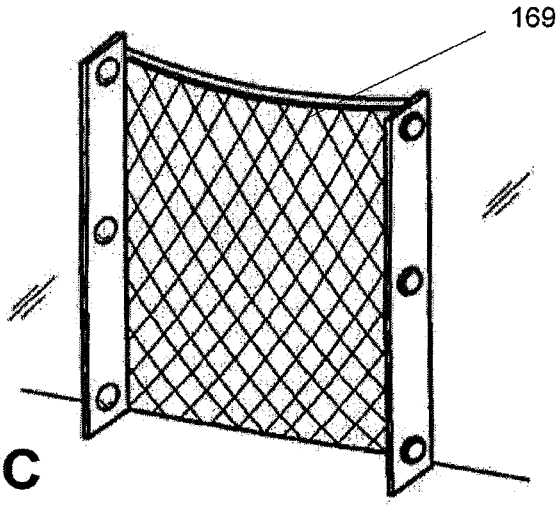
Figure 8D:
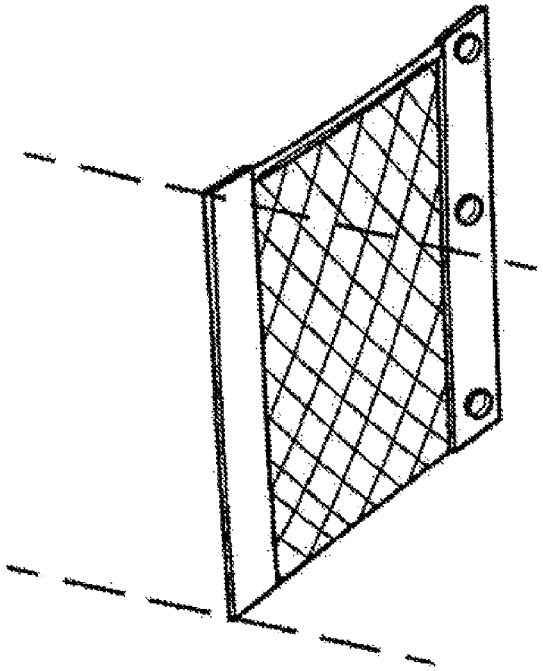

The storage systems disclosed in this specification provide a mechanism for the scent-free storage of hunting gear. A hunter's gear may become contaminated with various scents associated with humans. For example, when traveling through an airport the hunting gear may become contaminated with various human scents (e.g. perfumes, fuels, etc.). Game animals may detect these scents and avoid the hunter. The disclosed storage systems address this problem by providing a scent-free storage environment.

FIG. 1 to FIG. 8D depict a carrying case 100 for archery equipment and hunting gear. The carrying case 100 comprises a compartment 104 for archery equipment, including a bow, a compartment 130 for arrows 131, a compartment 106 for organizing additional items (e.g. clothing and the like); an external compartment 138 that houses a changing mat 136 and also houses a separate compartment 139 for the storage of hunting scents and lures.

The compartment 104 is configured to store archery equipment and includes a means to secure the bow (e.g. adjustment strap 123), a storage area for the arrows 131, and a divider 132 between the storage area for the bow and the storage area for the arrows 131. The divider 132 is defined by a flap which may be zipped shut. The compartment 104 further comprises triangular storage compartments 128 positioned near the corner areas of the compartment 104. In one embodiment, the triangular compartments are removable, being retained in their respective positions near the outer corner areas by hook-and-loop fabric and/or snaps (in one embodiment, both). The compartment 104 is on a first side of the carrying case 100 and includes a compartment closure 122 (i.e., a lid or door) manufactured of molded ethylene vinyl acetate with honeycomb and foam reinforcement and quilt stitched nylon on the internal surface. The means to secure the bow includes adjustment straps 123 to accommodate bows of varying sizes. The adjustment strap 123 may be permanently secured in position by rivets. The adjustment strap 123 is made of hypalon and the clip straps are nylon webbing. The adjustment strap 123 is secured at each end by rivets to the compartment closure and has a plurality of die-cut openings therein for receiving the adjustment straps 123 which allows for tightly securing a wide variety of commercially available bows.

The compartment 106 is configured to store hunting gear, including clothing. The compartment 106 is on a second side of the carrying case 100, the second side being opposite the first side. The compartment 106 is sealed by a zipper 144 and includes an extendable bag 140 disposed within an external shell for scent-free housing of hunting apparel. The external shell of compartment 106 is made of 840*d* nylon. An internal lining 140 is heat taped 210*d* nylon or the like both backed and faced with polyurethane, or the like. The outer shell functions as support, providing protection and durability while the extendable lining 140 locks out odors. The base of the extendable lining 140 is not sewn to the floor of the outer shell of compartment 106, allowing the extendable lining 140 to be lifted out for scrubbing. The extendable lining 140 has a zippered elastic mesh pocket and a non zippered inner pocket to serve for additional storage. In addition, the extendable lining 140 is colored for contrast and has snappable dividers 169 for additional organization.

The external compartment 138 stores a rollout changing mat 136 that is irremovably secured to a portion of the external compartment 138. The mat 136 is two layers of 210*d* nylon backed with polyurethane. In use, the changing mat 136 provides a place for the hunter to stand while changing clothes in the field. The external compartment 138 has a zipper closure that extends along a three-sided portion of its perimeter.

The carrying case 100 includes a detachable shoulder strap and first means 160 to clip one end of the strap to a first end of the carrying case 100 and second means 161 (see FIG. 1) to clip a second end of the strap to a second end of the carrying case 100, opposite the first end. To provide balance, the first clip is secured to the first end and the second clip to the second end. A padded portion is immovably attached (as by stitching) to the center of the strap. The length of the strap can be adjusted to accommodate the user. Carrying handles 99 stitched to each side have a gym-bag-type padded wrap 98 for comfort. Six feet 116, three spaced along each side, provide a platform for the case to rest upon when not being carried. Kick plates 118 positioned along the ends near the bottom provide protection for the case's contents.

Figure 20A:
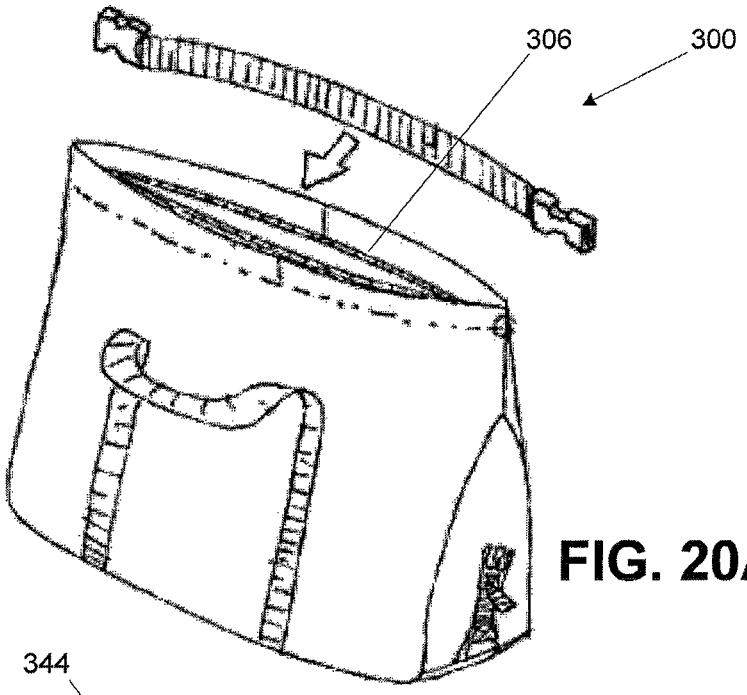
FIG. 20A and FIG. 20B are depictions of two pulls of a zipper track.
Figure 20B:
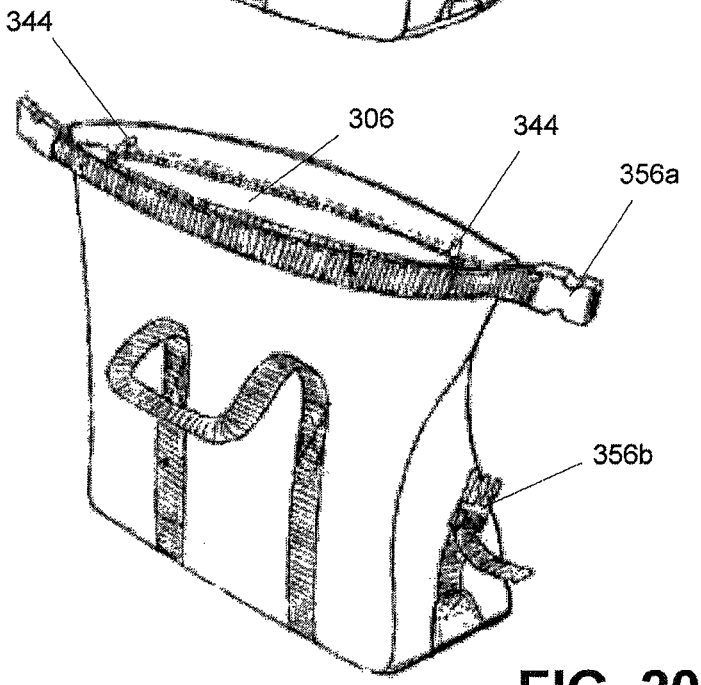

The carrying case 100 provides a scent-free environment. Specifically, the extendable bag 140 is permanently attached to the compartment 106. This permits control of the seal between the extendable bag 140 and the compartment 106 which a removable liner cannot achieve. Additionally, two pulls of a zipper track are provided that meet at a non-terminal position of the opening of the extendable bag 140 (see, for example, FIG. 20A and FIG. 20B). This configuration prevents the formation of an opening at the corners that results when only a single pull is used. When the zipper track is folded and rolled over on itself the opening between the two pulls is not located near the corner of the extendable linear and is more tightly sealed by the folding. This feature, combined with the sealed nature of the extendable linear permanently attached to an outer shell (thereby protecting the contents with two layers of material) results in the scent-free environment.

Another exemplary embodiment includes a carrying case 200 for archery equipment and hunting gear. With reference to FIG. 9 to FIG. 16, the carrying case 200 includes at least: (a) a first storage compartment 206 (defining a first storage space 206*a*) comprised of an outer shell which defines the first storage compartment 206 and includes an extendable lining 240; (b) a separate storage compartment 204 (defining a second storage space 204*a*) for clothing, boots, and the like; and (c) a mat compartment or external compartment 238 that houses a changing mat 236. The mat compartment or external compartment 238, having a pocket or cover 239 (FIG. 9), is closed with a zipper closure 238*a*. In the embodiment shown in FIGS. 9 and 11, the cover 239 and an exterior portion 289 of the side wall 283 collectively define a third storage space 291 for receiving the mat 236 when the mat compartment 238 is closed. The second storage compartment 204 is stacked below the first storage compartment 206 and attached thereto along three sides by a zipper 245 and permanently attached thereto along a fourth side 246. In the embodiment shown in FIG. 10, the case 200 includes: (a) a handle 247 having an extension 249 slidably insertable into a handle space 251 defined by the second storage compartment 204; (b) a grasp 253 connected to the extension 249; and (c) a plurality of elongated guards 255 connected to the bottom 257 of the second storage compartment 204. As shown, the case 200 has an elongated shape with ends 259, 261 space apart along a longitudinal axis 263, and the guards 255 extend parallel to the longitudinal axis 263.

Figure 9:
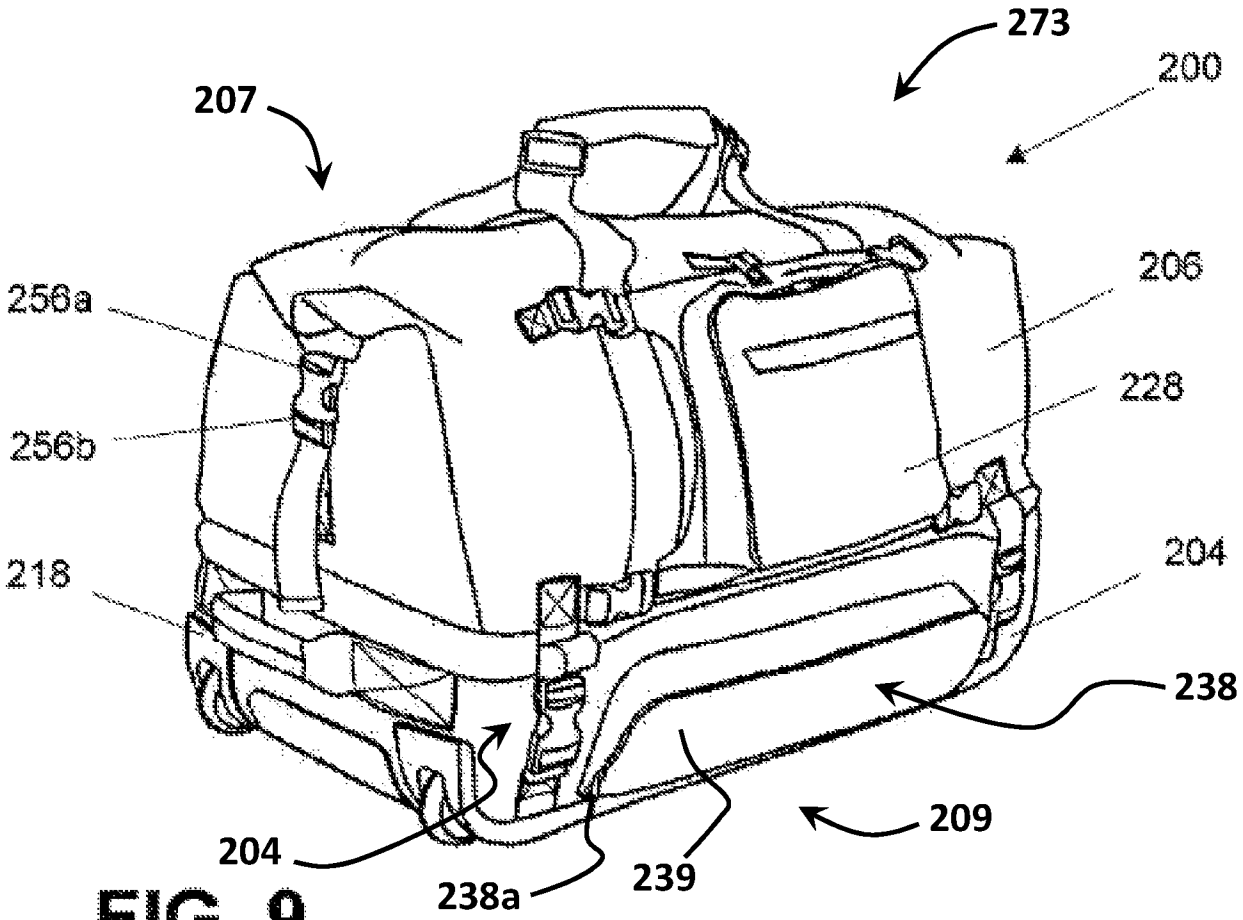
FIG. 9 is a front perspective view of a second embodiment of a storage system.
Figure 10:
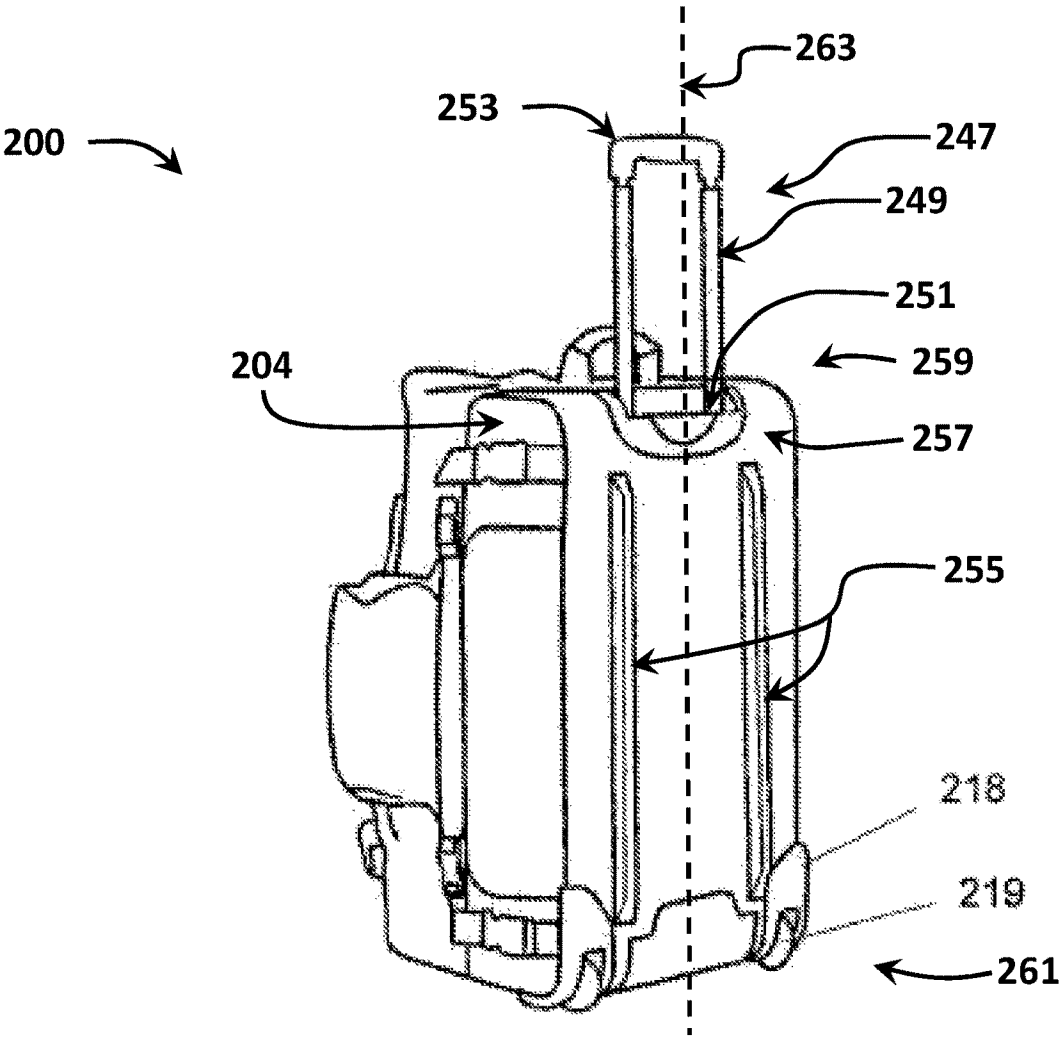
FIG. 10 is a rear perspective view of the second embodiment.
Figure 11:
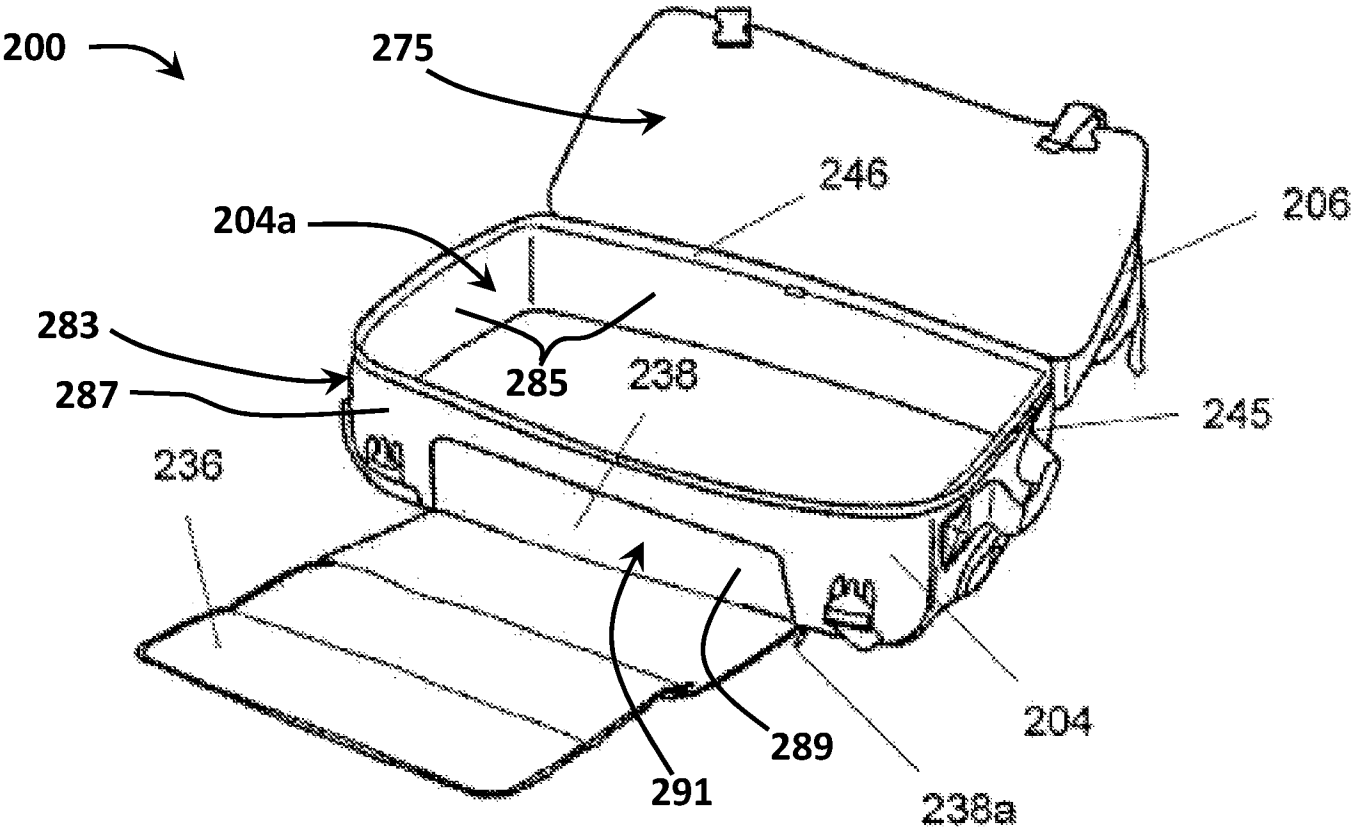
FIG. 11 is a rear perspective view of the second embodiment showing a changing mat extended.
Figure 12:
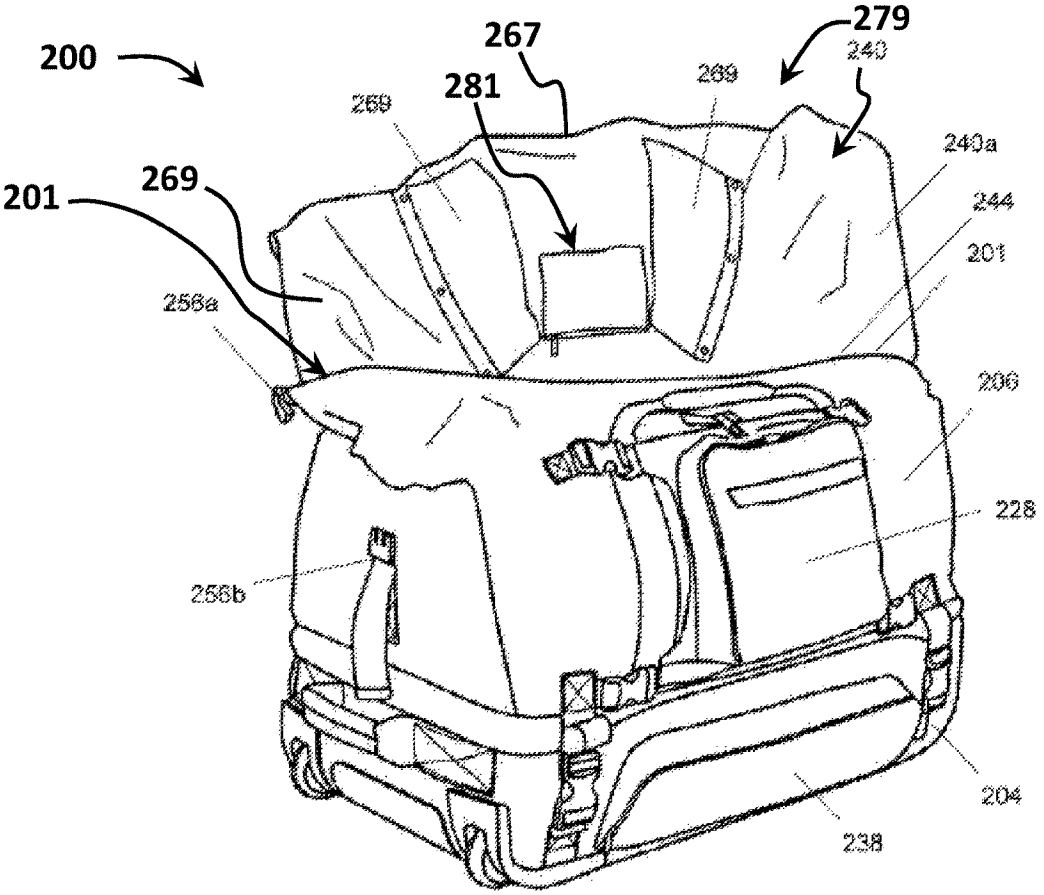
FIG. 12 is a front perspective view of the second embodiment with a clothing compartment lining extended.
Figure 13A:
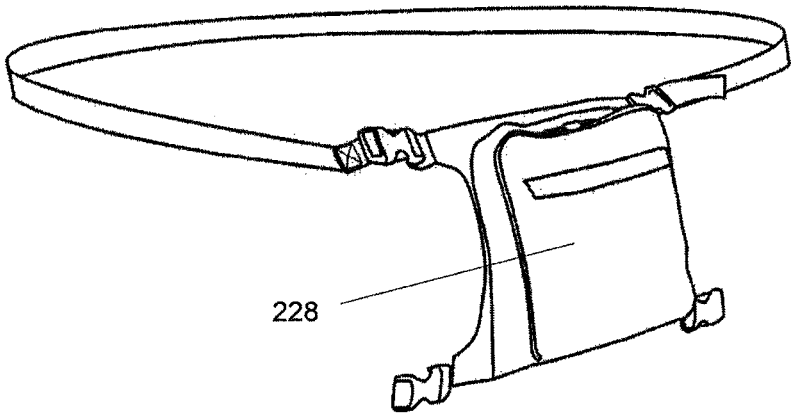
Figure 13B:
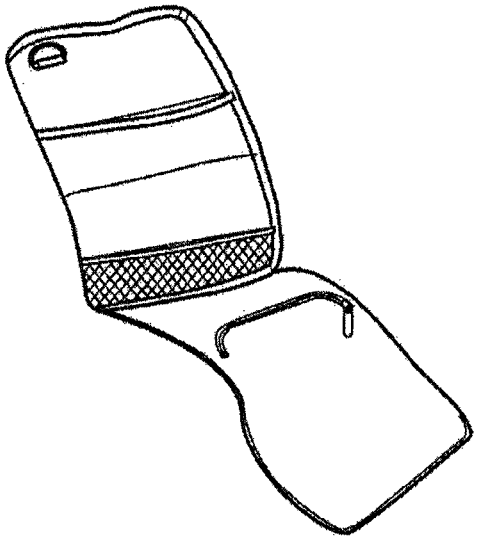
FIG. 13B depicts the bag in an opened state.
Figure 14A:
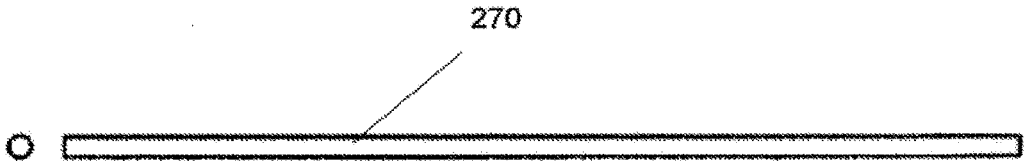
FIG. 14A and FIG. 14B are isometric views depicting a pair of poles for holding the bag in an open position and also illustrating interior portions of the bag.
Figure 14B:
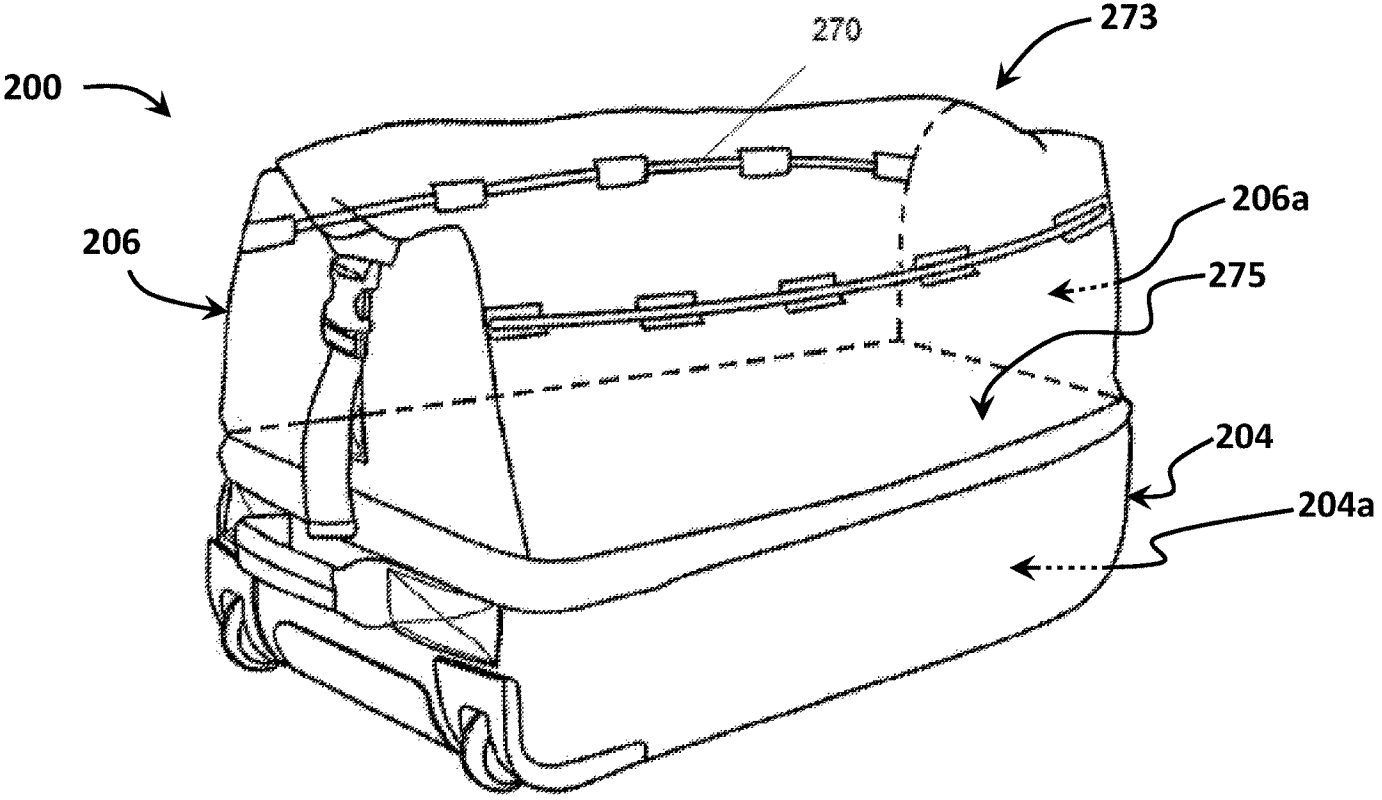
Figure 15:
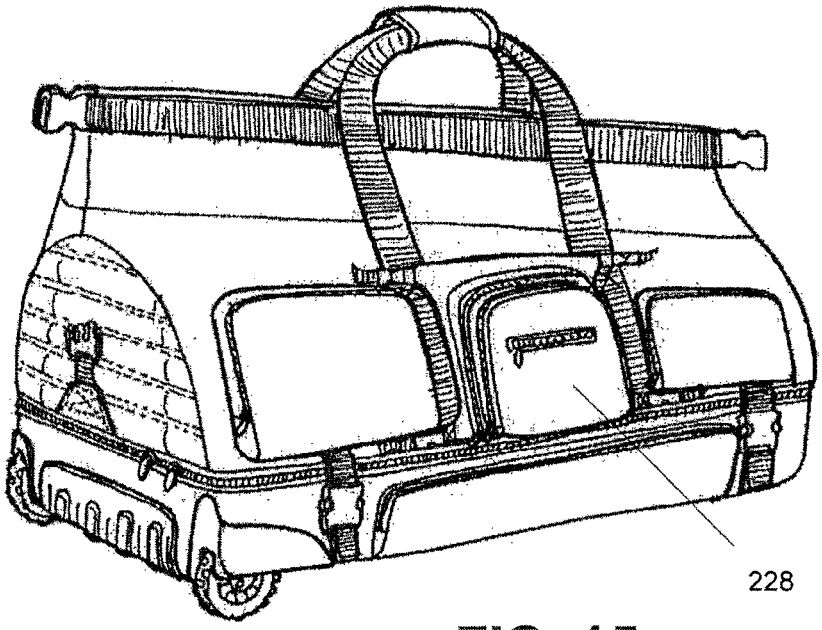
Figure 16:
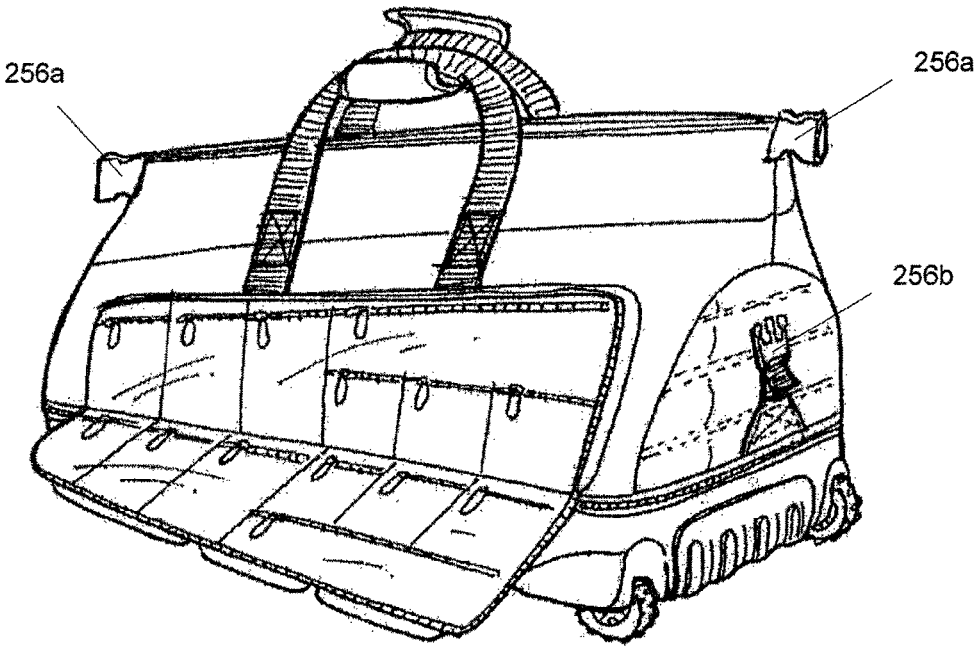
FIG. 16 shows the coupling of mating clips.
Figure 17:
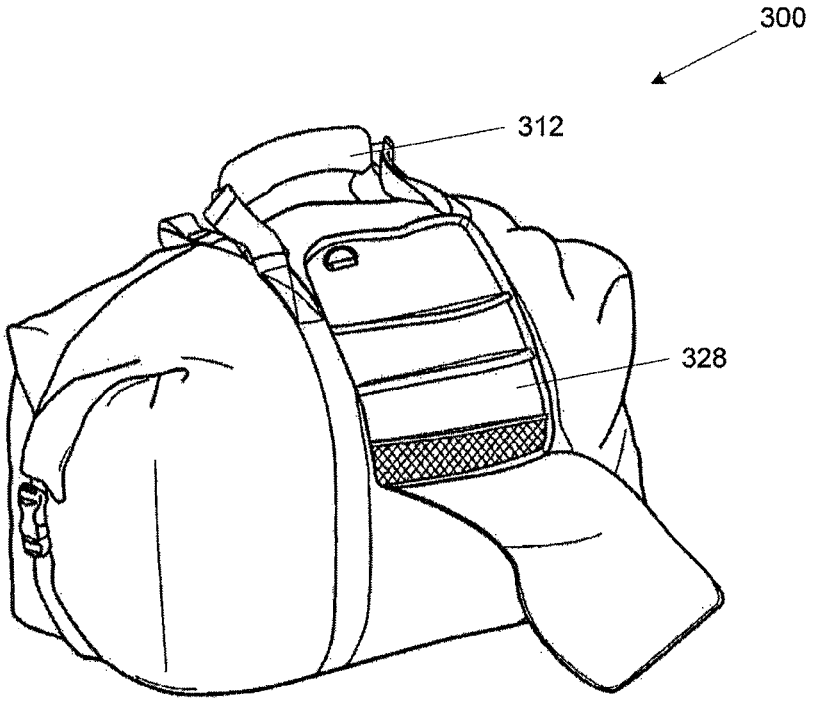
FIG. 17 is a perspective view of a third embodiment of a storage system.
Figure 19:
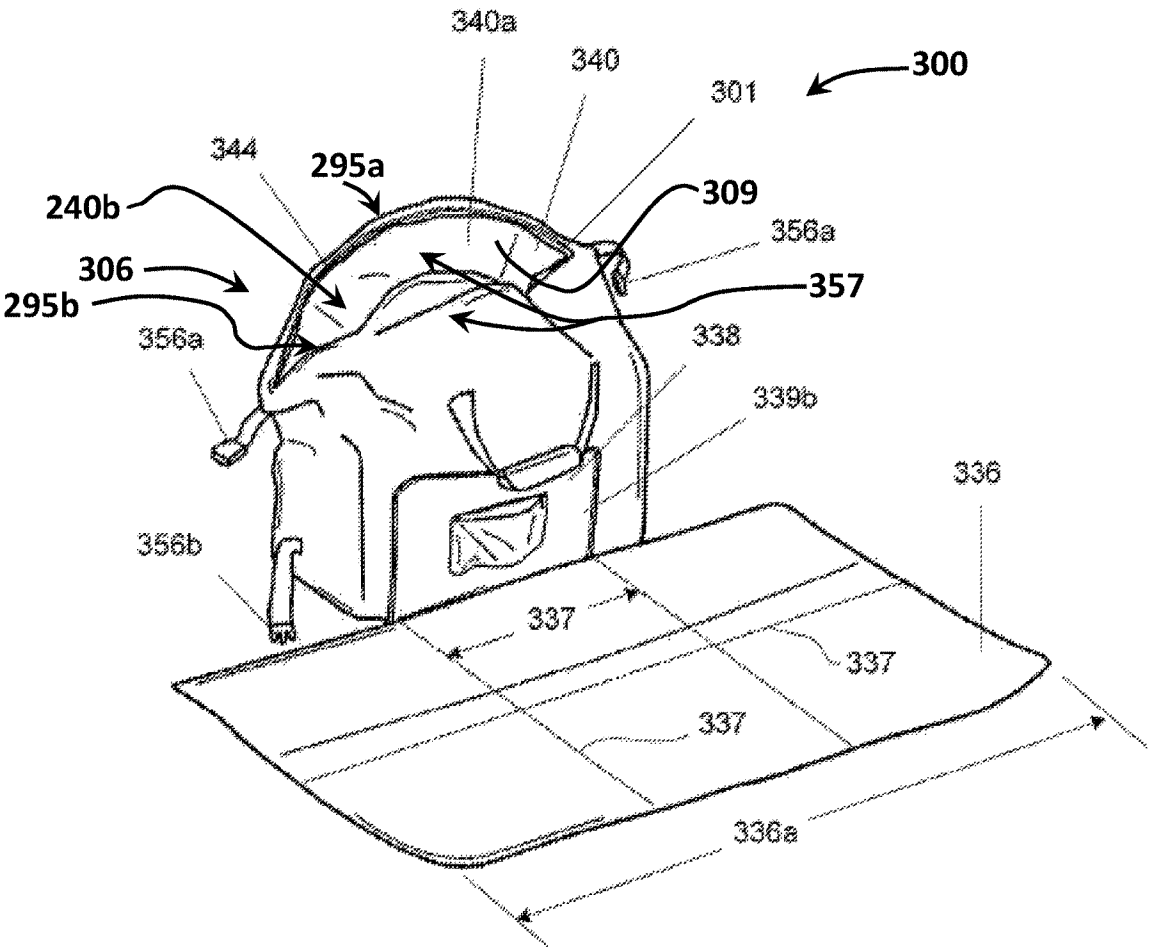
FIG. 19 illustrates the third embodiment with a changing mat extended.

As shown in FIG. 9, the first storage compartment 206 is on a top side 207 of the carrying case 200, the top side 207 being opposite the bottom side 209. As shown in FIG. 12, the first storage compartment 206 includes, internal to its external periphery, an extendable bag 240 with a bag bottom 267 and bag sidewalls 269 formed from the extendable lining 240 for scent-free housing of hunting apparel. The bag 240 defines a bag space 240*b* (FIG. 19). The compartment 206 is sealed with a zipper 244 with two pulls at a top end, edge or periphery 201 (FIG. 12) of the first storage compartment 206. Clips 256*a* flank the zipper 244 and, when secured to corresponding clips 256*b*, secure the compartment 206 and its contents in a rolled-up condition 273 (FIGS. 9, 14B and 17). The external shell is made of 840*d* nylon; internal lining is heat taped 210*d* nylon or the like both backed and faced with polyurethane, or the like. In one embodiment, the flexible lining 240 has a waterproof coating 240*a* on its surface. The outer shell functions as support, providing the protection and durability while the extendable lining 240 locks out odors. The base or bag bottom 267 of the extendable lining 240 is not sewn to the compartment floor 275 (FIGS. 11 and 14B) of the external shell but is joined to the first storage compartment 206 only around the edge or periphery 201 of the first storage compartment 206, allowing: (a) the extendable bag 240 to be lifted out for scrubbing; and (b) the bag bottom 267 to be moved from a first position within the first storage space 206*a* (FIG. 14B) to a second position 279 (FIG. 12) outside of the first storage space 206*a*. The extendable lining 240 has a zippered elastic mesh pocket 281 and a non-zippered inner pocket to serve for additional storage. In addition, the extendable lining 240 is colored for contrast and has snappable dividers 269 for additional organization. A rollout changing mat 236 is irremovably secured to a portion of the mat compartment or external compartment 238. The changing mat 236 comprises two layers of 210*d* nylon that is backed and faced with polyurethane. In the embodiment shown in FIG. 11, the second storage compartment 204 has a perimeter side wall 283 which includes an interior surface 285 and an exterior surface 287.

Kick plates 218 positioned along the ends near the bottom provide protection for the case's contents. Carrying handles stitched to each side have a handle wrap for comfort. Carrying case 200 also comprises wheels 219. Carrying case 200 further comprises a detachable field bag 228 removably connected to the compartment 206. In FIG. 14A and 14B, a pair of poles 270, each on a respective side of the zipper 244 of the first compartment 204, hold the first compartment 204 in an open position.

Figure 18:
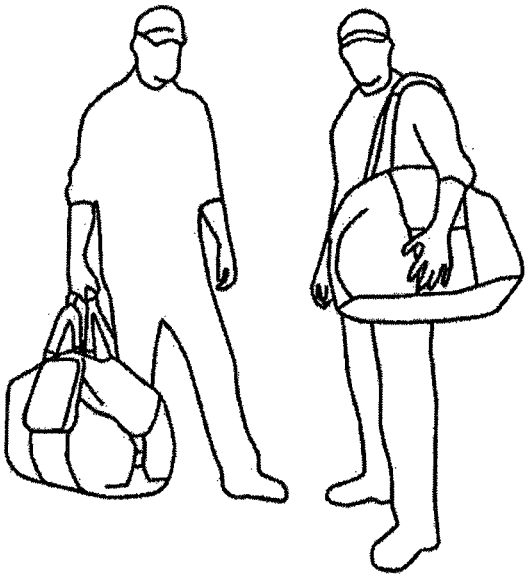
FIG. 18 illustrates the third embodiment being held by a human hand or supported by a human shoulder.

FIG. 17 is a perspective view of a third carrying case 300. With reference to FIGS. 17-19 carrying case 300 comprises an adjustable handle 312 at the top end of the bag. A compartment 306 is sealed by a zipper 344 with two pulls. See FIG. 20A and FIG. 20B. Clips 356*a* flank the zipper 344. Clips 356*a* are configured to mate with clips 356*b*. Like compartments 106 and 206, the compartment 306 is configured to have zipper 344 rotated in a rotary direction and then the fabric top is folded and rolled over on itself, overlapping and surrounding the zipper 344 to create a scent-free environment. Thereafter, clips 356*a* and 356*b* are mated which seals the compartment 306 and maintains the compartment 306 in a closed state and provides a substantially scent-free environment. The folding-closure provides control over the airflow within the compartment 306 to limit the intrusion or release of scents. A rigid strip or stiffener 293 (FIGS. 17A and 19-23) may be disposed along the edge or perimeter 295*a* of the opening of compartment 306 to promote the folding. Perimeter 295*a* is located opposite of edge or perimeter 295*b* (FIG. 19). As shown in FIGS. 17A and 19, the zipper track or zipper 344 is inset such that the rigid strip or stiffener is above the zipper 344 such as in the configuration illustrated in FIG. 22. Such a configuration insures the zipper 344 will be at the center of the folding-closure The carrying case 300 may comprise one or more storage compartments 328 on its external surface. Depending on the adjusted length of the handle 312, the carrying case 300 can be carried by hand or strapped over one's shoulder. See FIG. 18.

The compartment 306, having separable edges or perimeters 295*a*, 295*b*, is formed by an extendable bag 340, similar to lining 140 and 240, that attaches to the carrying case 300 at the periphery 301 of the zipper 344. When the case 300 is positioned upright in unrolled condition as shown in FIG. 19, the liner or bag 340 has side surfaces (e.g., side surface 309) that extend upward toward the zipper 344. The flexible liner or bag 340 is free floating such that the bottom of the liner or bag 340 can be inverted to pass through the opening provided by zipper 344. In one embodiment, the flexible liner or bag 340 has a waterproof coating 340*a* on its surface. Such a configuration permits the liner or bag 340 to be inverted to permit easy cleaning. Additionally, the configuration provides a second layer that promotes a sealed environment and prevents scents from leaving the compartment 306 and/or water from entering the compartment 306.

In one embodiment, the carrying case 300 comprises an extended changing mat 336 that is permanently attached to a lower edge of the carrying case 300. In FIG. 19. the extended changing mat 336 is shown in an extended state. When not in use the extended changing mat 336 can be folded along fold lines 337 and placed inside of an external compartment 338, which is then closed by a zipper 339*b*. Since the extended changing mat 336 is permanently attached to the lower edge of the carrying case 300, the extended changing mat 336 cannot be lost. The extended changing mat 336 has a width 336*a* that exceeds the width 339*a* of the external compartment 338 in which the mat is attached. Advantageously, this provides a large surface area which a hunter can use to change.

Figure 21:
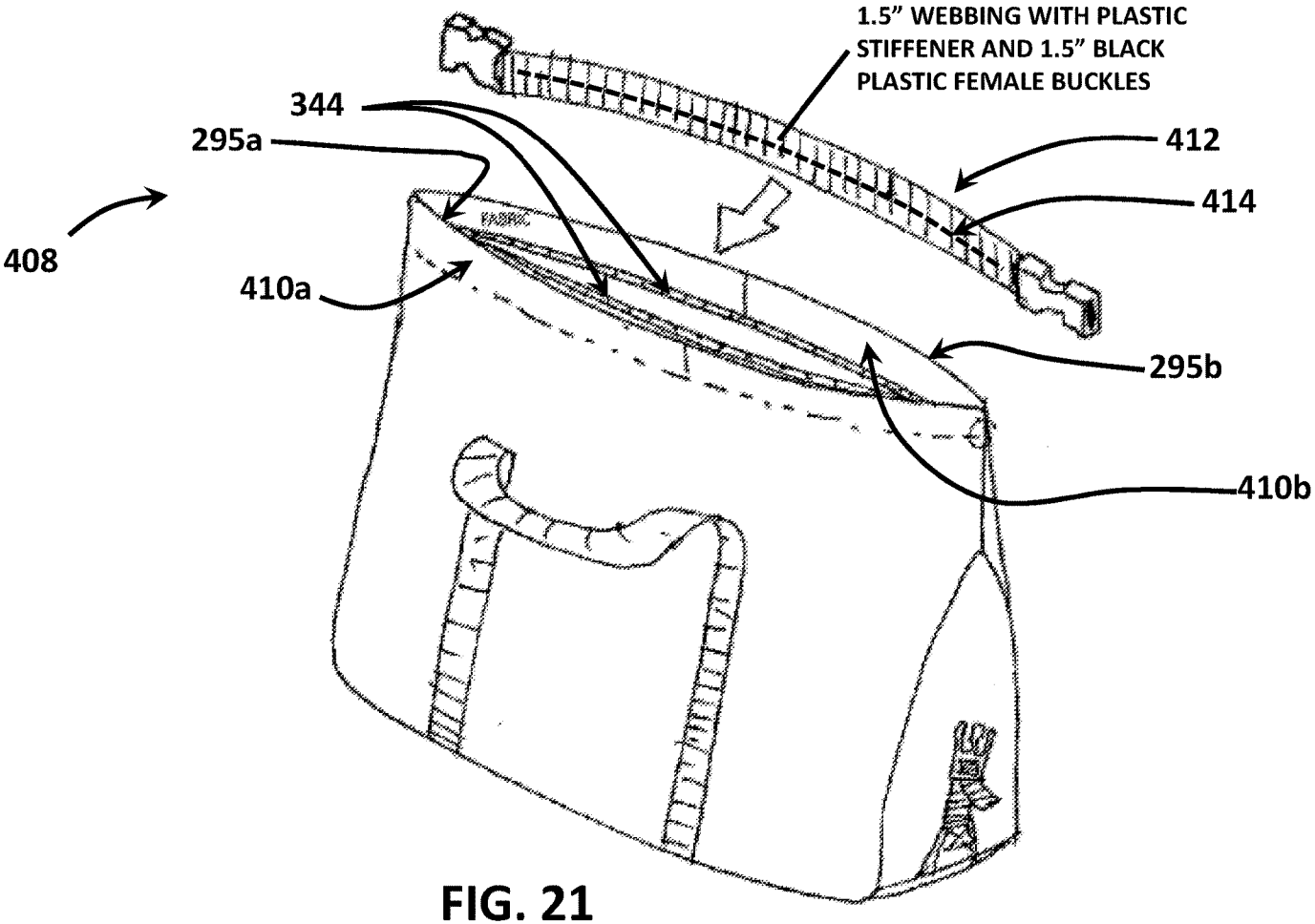
FIG. 21 is an isometric view of an embodiment of a case, illustrating the webbing with stiffener removed from the case.
Figure 22:
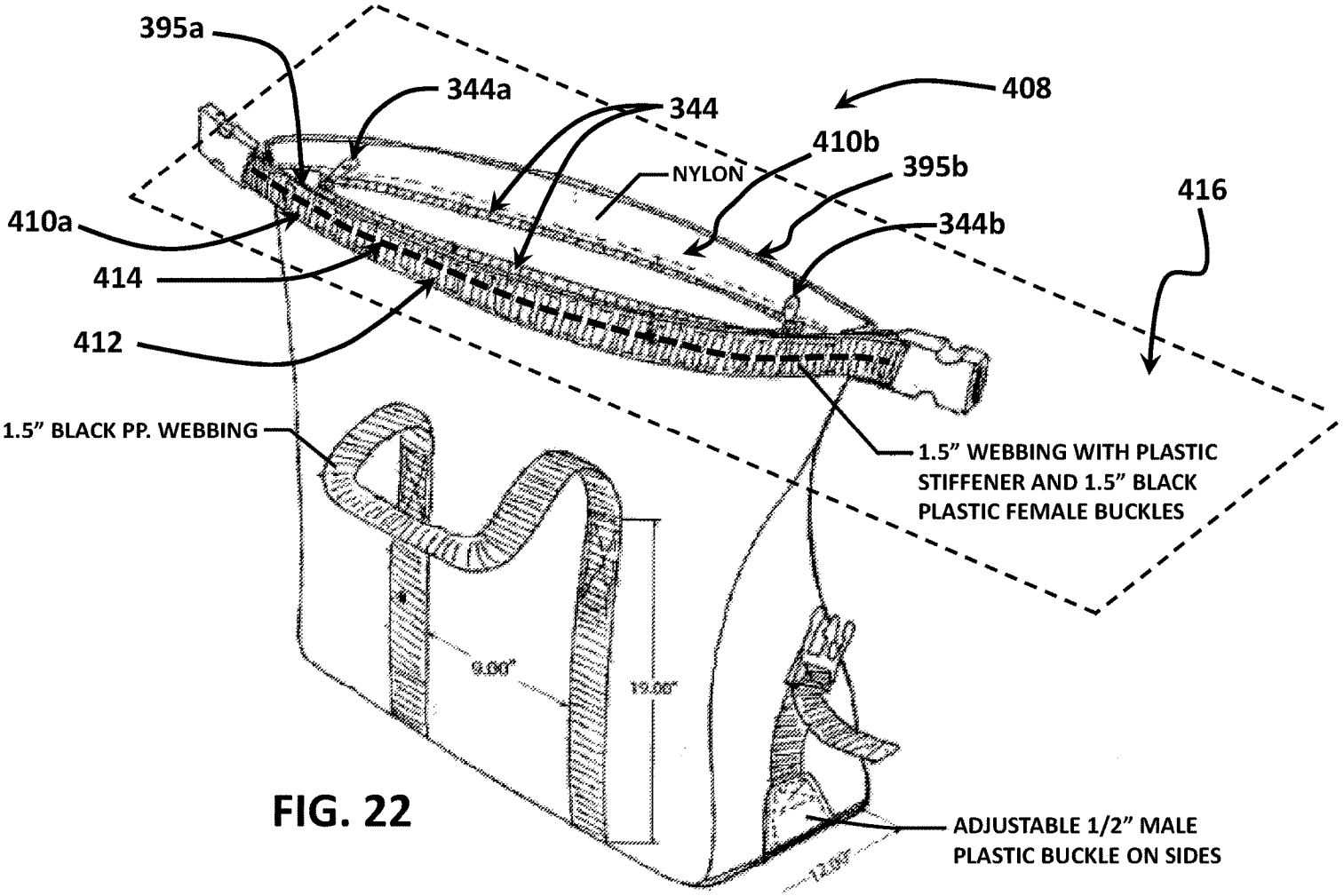
FIG. 22 is an isometric view of an embodiment of the case of FIG. 21, illustrating the zipper strip and the webbing with stiffener attached to the case.

In an embodiment illustrated in FIGS. 21-22, case 408 includes: (a) distal sections 410*a*, 410*b*; (b) zipper 344 connected to both sections 410*a*, 410*b*; and (c) webbing 412 connected to section 410*a*. Webbing 412 includes a stiffener strip or stiffener 414. In this embodiment, zipper 344 has pulls 344*a*, 344*b*. As shown, zipper 344 is inset such that stiffener 414 extends in a plane 416, and the plane 416 is located above the zipper 344 when the case 408 is positioned upright in the unrolled condition.

Figure 23:
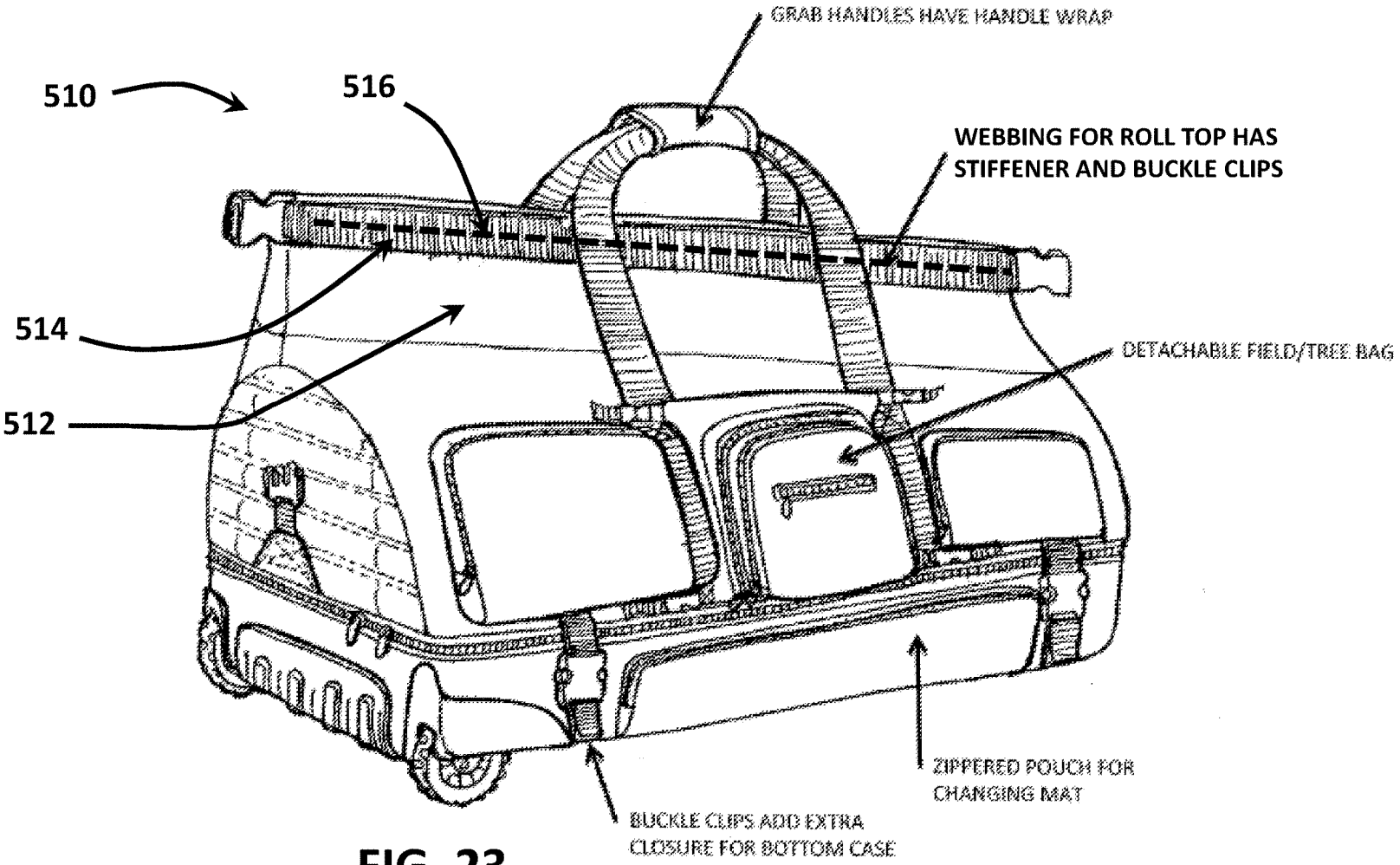
FIG. 23 is an isometric view of an embodiment of a case, illustrating the webbing having a stiffener and buckle clips.

In an embodiment illustrated in FIG. 23, case 510 has a roll top 512 and a webbing 514 connected to the roll top 512. The webbing 514 includes a stiffener 516.

Figure 24:
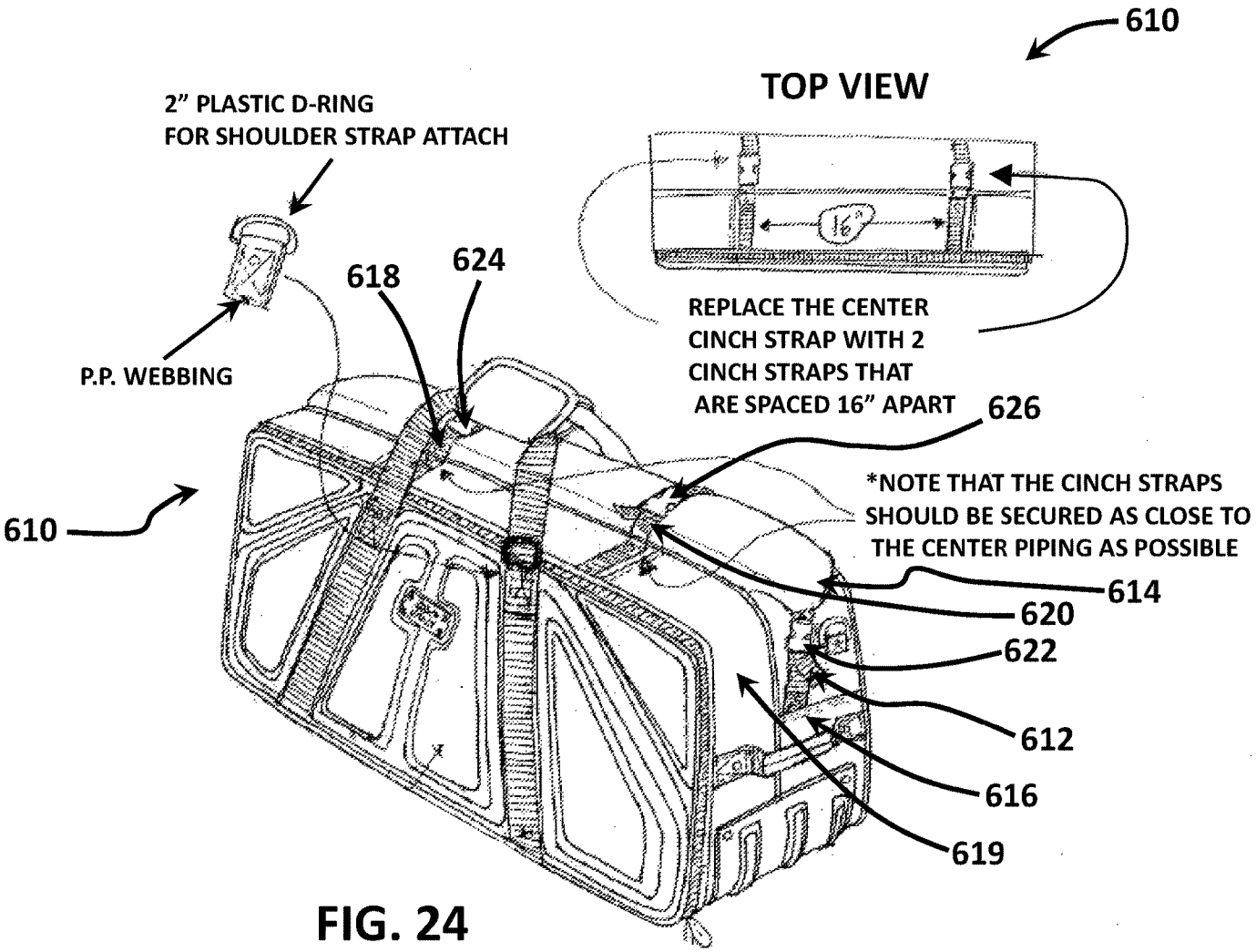
FIG. 24 is an isometric view of an embodiment of a case, illustrating an end strap and a plurality of top straps.

In an embodiment illustrated in FIG. 24, the case 610 includes a plurality of end couplers or end straps, including a left end strap (not shown) and a right end strap 612. As shown, the right end strap 612 secures the upper case portion 614 to the lower case portion 616. Case 610 also has a plurality of top couplers or top straps, including a left top strap 618 and a right top strap 620. As shown, the left top strap 618 secures the upper case portion 614 to the front case portion 619, and the right top strap 620 also secures the upper case portion 614 to the front case portion 619. Each of the straps 612, 618 and 620 include buckles 622, 624, 626, respectively.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A carrying case comprising:

a storage compartment defining a space, the storage compartment comprising:

a plurality of sections separable to provide access to the space;

a zipper coupled to the sections; and an extendable bag, the extendable bag comprising a bottom, wherein the bottom is decoupled from the storage compartment so that the bottom is configured to be moved from a first position in which the bottom is located within the space to a second position in which the bottom is located outside of the space;

a plurality of first clips, one adjacent to each end portion of the zipper;

a plurality of second clips on opposite ends of the carrying case, each second clip being configured to mate with a corresponding first clip;

a stiffener strip extending in a plane, wherein the plane is located above the zipper when the storage compartment is positioned upright before being partially rolled-up, the storage compartment configured to be at least partially rolled-up when the stiffener strip is folded over the zipper at least once; and a mat compartment coupled to the storage compartment, the mat compartment housing an extendable changing mat.

2. The carrying case of claim 1, wherein the storage compartment comprises a flexible portion configured to be rolled-up when the bottom of the bag is within the space, wherein the flexible portion has a roll-up form when rolled-up, the roll-up form extending along a longitudinal axis.

3. The carrying case of claim 2, wherein:

the flexible portion of the storage compartment includes the stiffener strip; and when the flexible portion has the rolled-up form, at least part of the flexible portion overlaps the zipper.

4. The carrying case of claim 3, further comprising a detachable field bag removably connected to the storage compartment.

5. The carrying case of claim 1, wherein:

the storage compartment comprises a first storage compartment defining the space;

the first storage compartment comprises a compartment floor located below the bottom of the extendable bag when the extendable bag is within the space;

the carrying case comprises a second storage compartment located below the compartment floor; and the mat compartment is connected to one of the second storage compartment or the mat compartment.

6. The carrying case of claim 5, wherein the second storage compartment comprises a plurality of sides, at least one of the sides comprising an exterior, wherein the mat compartment is connected to the exterior of the at least one side.

7. The carrying case of claim 6, wherein the first storage compartment comprises an exterior surface comprising a first coupler, and the carrying case comprises a detachable bag comprising a second coupler, the second coupler being configured to cooperate with the first coupler to enable the detachable bag to be removably mounted to the exterior surface of the first storage compartment.

8. The carrying case of claim 7, wherein:

the space defined by the first storage compartment comprises a first storage space;

the second storage compartment defines a second storage space;

the second storage compartment comprises a fastener;

the extendable bag defines at least part of a bag space;

the extendable bag is configured to: (a) isolate a scent of a first item placed in the extendable bag when the first storage compartment is at least partially rolled-up causing the extendable bag to enclose the bag space; and (b) impede the scent from escaping the enclosed bag space;

when the fastener encloses the second storage space, the compartment floor is configured to further impede any portion of the scent from passing from the first storage space into the second storage space; and the exterior of the at least one side is configured to impede any mat scent from the extendable mat from entering into the second storage space, wherein the extendable bag, the compartment floor and the exterior are configured to guard a second item in the second storage space from being odorized by the scent of the first item or the mat scent.

9. The carrying case of claim 1, wherein:

the storage compartment is flexible and configured to be deformed and rolled;

the stiffener strip is configured to promote folding of the first storage compartment; and a portion of the extendable changing mat is secured to the carrying case.

10. The carrying case of claim 1, wherein:

the zipper comprise at least one pull;

when the storage compartment is at least partially rolled-up, a portion of the storage compartment surrounds the zipper and the at least one pull to establish an airtight seal so as to block air communication between the space of the compartment and an external environmental; and the carrying case comprises at least one strap configured to engage a top of the storage compartment after the storage compartment is at least partially rolled-up.

11. A case comprising:

a first storage compartment defining a first storage space, the first storage compartment comprising:

a flexible upper portion; and a bag defining a bag space configured to hold a first item, wherein:

(a) the bag comprising a bottom and a plurality of side surfaces, wherein the flexible upper portion is configured to be rolled upon itself while the bottom of the bag is within the first storage space;

(b) the flexible upper portion comprises a plurality of sections, a plurality of first fasteners and a zipper coupled to the sections, the zipper being operable to provide access to the bag space, (c) a region of each side surface of the bag is coupled to the flexible upper portion;

(d) the bottom of the bag is configured to be moved to a position outside of the first storage space while the regions of the side surfaces remain coupled to flexible upper portion of the first storage compartment;

a plurality of second fasteners attached to opposite ends of the case, each one of the second fasteners being configured to engage with one of the first fasteners;

at least one stiffener coupled to at least one of the sections, wherein the at least one stiffener is configured to facilitate the rolling of the flexible upper portion;

a second storage compartment defining a second storage space configured to receive and enclose a second item; and a mat compartment coupled to the second storage compartment, the mat compartment configured to hold a mat, wherein, before the flexible upper portion is rolled:

(a) the stiffener extends in a plane; and (b) the plane is located above the zipper when the case is positioned so that the first storage compartment is above the second storage compartment.

12. The case of claim 11, wherein the flexible upper portion is configured to be rolled-up when the first item is within the bag space, wherein the flexible upper portion transforms to a rolled-up form when rolled-up, the rolled-up form extending along a longitudinal axis.

13. The case of claim 12, wherein:

a plurality of the first fasteners or the second fasteners are configured to be adjustable to enable compression of the flexible upper portion after the flexible upper portion has been transformed to the rolled-up form;

the stiffener comprises a stiffener strip; and a third fastener coupled to the flexible upper portion;

a fourth fastener coupled to the second storage compartment; and a strap connected to the third and fourth fasteners, wherein the strap is configured to engage a top of the rolled-up form of the flexible upper portion.

14. The case of claim 12, further comprising a plurality of wheels.

15. The case of claim 11, wherein, when the first item is placed in the bag, the bottom of the bag is inside of the first storage space, the zipper is closed and the flexible upper portion is rolled about the at least one stiffener at least once: (a) the bag impedes a scent of the first item from escaping the bag space, (b) a compartment floor of the first storage compartment impedes any of the scent from reaching the second item enclosed within the second storage space, and (c) an exterior portion of the second storage compartment impedes any mat scent from reaching the second item enclosed within the second storage space.

16. The case of claim 11, wherein:

the first storage compartment comprises a plurality of sides and a compartment floor between the first and second storage spaces;

the bag comprises a waterproof coating;

the mat is connected to one of the second storage compartment or the mat compartment; and the case comprises at least one detachable field bag removably connected to one of the sides of the first storage compartment.

17. The case of claim 11, wherein:

each of the sections extends within the plane before the flexible upper portion is rolled when the case is positioned so that the first storage compartment is above the second storage compartment; and the sections are configured to be engaged with each other, wherein the stiffener promotes rolling of flexible upper portion while the sections are engaged with each other.

18. The case of claim 11, wherein the zipper comprise at least one pull; and when the flexible upper portion is at least partially rolled-up, at least part of the flexible upper portion covers the zipper and the at least one pull to establish an airtight seal so as to block air communication between the bag space and an external environment.

19. A case comprising:

a first storage compartment defining a first storage space, the first storage compartment comprising:

(a) a plurality of sides, wherein each of the sides comprises a flexible portion, each of the flexible portions comprises a section, and the sections are configured to be separated to provide access to the first storage space;

(b) a bag coupled to the sides, the bag comprising a bag bottom, the bag defining a bag space configured to hold a first item, wherein the bag bottom is configured to be moved from a first bag position within the first storage space to a second bag position outside of the first storage space while the bag remains coupled to the first storage compartment; and (c) an elongated fastener configured to couple the sections together;

at least one stiffening member coupled to at least one of the sections, wherein:

(a) the at least one stiffening member extends along an axis; and (b) the at least one section is configured to be folded around the elongated fastener;

a second storage compartment coupled to the first storage compartment, the second storage compartment comprising a side wall, the side wall comprising:

(a) an interior surface defining a second storage space configured to receive a second item; and (b) an exterior surface; and a mat compartment comprising a cover coupled to the side wall of the second storage compartment, the mat compartment defining a third storage space when the cover is fastened to the side wall, wherein the third storage space is configured to receive a mat, wherein, when the case is oriented upright before the at least one section is folded around the elongated fastener, the at least one stiffening member extends in a plane that is located above the elongated fastener.

20. The case of claim 19, wherein:

the first storage compartment comprises a compartment floor located below the bag bottom when the bag bottom is positioned within the first storage space;

after the at least one of the section is folded around the elongated fastener, the flexible portions are configured to be rolled to cover any gap between the elongated fastener and the first storage compartment to impede any air communication between the first storage space and an environment in which the storage case is located; and the case comprises an end coupler configured to couple to the second compartment, an end of at least one of the sections; and the case comprises a top coupler configured to couple to the second compartment, a top of a rolled-up form of the flexible portion, when the first item is placed in the bag space, the second item is placed in the second storage space, and the mat is placed in the third storage space, the bag and the side wall are configured to impede odors of the first item and the mat from traveling to the second item.

21. The case of claim 20, wherein:

the mat comprises:

(a) a first mat end configured coupled to one of the second storage compartment or the mat compartment; and (b) a second mat end configured to be moved from a first mat position within the third storage space to a second mat positioned outside of the third storage space;

each of the first and second storage compartments comprises an elongated shape extending along the axis; and the case comprises:

(a) first and second ends spaced apart along the axis; and (b) a plurality of wheels located at a first one of the ends;

the second storage compartment defines a handle space; and the case comprises a handle, wherein the handle comprises an extension configured to be slidably received within the handle space, wherein the handle further comprises a grasp coupled to the extension, wherein, when the extension is fully inserted into the handle space, the grasp is located at the second end of the case.

22. The case of claim 21, wherein:

the second storage compartment comprises a bottom; and the case comprises a plurality of elongated guards coupled to the bottom, wherein the elongated guards extend parallel to the axis.

* * * * *